US008985817B1

(12) United States Patent
Schalch, III

(10) Patent No.: US 8,985,817 B1
(45) Date of Patent: Mar. 24, 2015

(54) LAMP GUARD

(76) Inventor: Louis G. Schalch, III, Cotati, CA (US)

( * ) Notice: Subject to any disclaimer, the term of this patent is extended or adjusted under 35 U.S.C. 154(b) by 0 days.

(21) Appl. No.: 13/154,116

(22) Filed: Jun. 6, 2011

Related U.S. Application Data

(60) Provisional application No. 61/351,564, filed on Jun. 4, 2010.

(51) Int. Cl.
*F21V 15/00* (2006.01)

(52) U.S. Cl.
USPC ..... 362/376; 362/145; 362/147; 362/186; 362/362

(58) Field of Classification Search
CPC ..... G02F 1/00; F21V 1/00; F21V 15/02
USPC ..... 362/376, 147, 377, 378, 400, 404, 145, 362/186
See application file for complete search history.

(56) References Cited

U.S. PATENT DOCUMENTS 3,826,912 A 7/1974 Pomroy
4,791,541 A 12/1988 Simmons
6,910,787 B2 6/2005 Thome et al.

*Primary Examiner* — Anh Mai
*Assistant Examiner* — Jessica M Apenteng
(74) *Attorney, Agent, or Firm* — Craig M. Stainbrook; Stainbrook & Stainbrook, LLP

(57) ABSTRACT

A light guard that includes a planar base plate having a center hole sized to permit the passage of a light socket and opposing side slots disposed substantially 180 degrees apart from one another, the base plate having an outer circumference sized substantially the same as the outer dimension of a selected electrical outlet box. The base plate also includes a keyhole slot proximate said outer circumference of the base plate and a transverse slot proximate the outer circumference of the base plate, each of the slots sized to accommodate screws for securing and mounting the base plate onto an outlet box or a plaster ring mounted on the outlet box. Spokes of substantially equal length extend from the base plate, and at least two rings connect the spokes to form a light bulb cage with an open bottom end, thereby providing free access to an installed light bulb.

6 Claims, 3 Drawing Sheets

LAMP GUARD

CROSS REFERENCES TO RELATED APPLICATIONS

The present application claims the benefit of U.S. Provisional Patent Application Ser. No. 61/351,564 filed Jun. 4, 2010 (Jun. 4, 2010.)

SEQUENCE LISTING

Not applicable.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to lamp guards, and more particularly to a lamp cage or lamp guard for protecting an electric light or lamp screwed into an electric socket installed in an outlet box. The inventive apparatus is particularly well-suited for use in mounting the cage on outlet boxes newly installed in a wall or ceiling in a building under construction.

2. Discussion of Related Art Including Information Disclosed Under 37 CFR §§1.97, 1.98

Lights in construction sites are especially vulnerable to damage and destruction. Lamp cages used in such sites are generally designed to snap on to the socket portion of an installed lamp holder or, alternatively, to mount on the lamp holder with screws. Exemplary lamp guards and cages, as well known the many purposes for which they have been devised, are shown and described in the following U.S. patents:

U.S. Pat. No. 6,910,787, to Thome, et al, which teaches a light guard having a base flange removably mountable to the fixed surface of a light socket and a body portion extending from the base flange for surrounding the electric lamp.

U.S. Pat. No. 4,791,541, to Simmons, shows a molded single-piece lamp cage that includes stationary and hinged cage sections connected to one another by a living hinge. This permits the hinged section to be open for changing the lamp without removing the cage from the socket. An integrally molded collar and a hinged clamp enable the cage to be installed on the socket without need of tools or hardware.

U.S. Pat. No. 3,826,912, to Pomroy, discloses a light guard cage comprising identical halves each having integral upper semi-circular bands that snap together to form an upper annular collar that engages the rib or recess of a light socket.

The foregoing documents and discussion reflect the current state of the art of which the present inventor is aware. However, it is respectfully submitted that none of the above-indicated patents disclose, teach, suggest, show, or otherwise render obvious, either singly or when considered in combination, the invention described and claimed herein. Specifically, and despite the apparent maturity of this art, there remains a need for a lamp guard that may be temporarily installed directly on an electrical outlet box or on a plaster ring installed on an outlet box so as to hold a light socket within the box and to protect exposed wires. Such a device would be advantageous when used in construction sites where wall and/or ceiling installation is still underway, where access to outlet mounted lamp holders is needed, and where wall surfaces and finishing procedures must be completed before the installation of a permanent lamp holder.

BRIEF SUMMARY OF THE INVENTION

The present invention is a lamp guard adapted for rapid installation directly over an open outlet box or on a plaster ring secured to an outlet box. The lamp guard may be secured over several kinds of mid-base electric light sockets and actually holds the light socket at least partly within the outlet box until the cage and socket are removed for installation of a permanent lamp holder, which is generally a conventional glazed porcelain and white urea mounted on the outlet box. These are typical in most residential and small office construction. The guard is configured for rapid lamp removal and/or replacement, and it is therefore particularly well-suited for use in construction sites where wall installation, texturing, painting, and the like are still underway.

It is therefore a principal object of the present invention to provide a lamp guard that covers exposed wires in an outlet box so as to reduce the risk of shock to construction workers.

It is another object of the present invention to provide a lamp guard that mounts directly to a conventional 3/O electrical box or to a plaster ring installed over an outlet box in preparation for the application of a wall finish.

Yet another object of the present invention is to provide a lamp guard that has an outside diameter no larger than a plaster ring or outlet box and therefore may be used while the installation of drywall panels (i.e., gypsum board or plaster board), plastering, taping, and wall finishing are still underway, and during which the inventive lamp guard need not be removed. Use in numerous environments other than construction sites is clearly contemplated.

A still further object of the present invention is to provide a lamp guard that holds a light socket within the interior space of an outlet box during construction. Such sockets are preferably medium base light sockets, such as are used with compact fluorescent light bulbs, though dimensions may be adjusted for handling smaller and larger lamps, as well.

Another, though not final, object of the present invention is to provide a light cage that may be reused an indefinite number of times, so as to minimize material waste and the needless consumption of energy for and manufacturing and disposal.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 2:
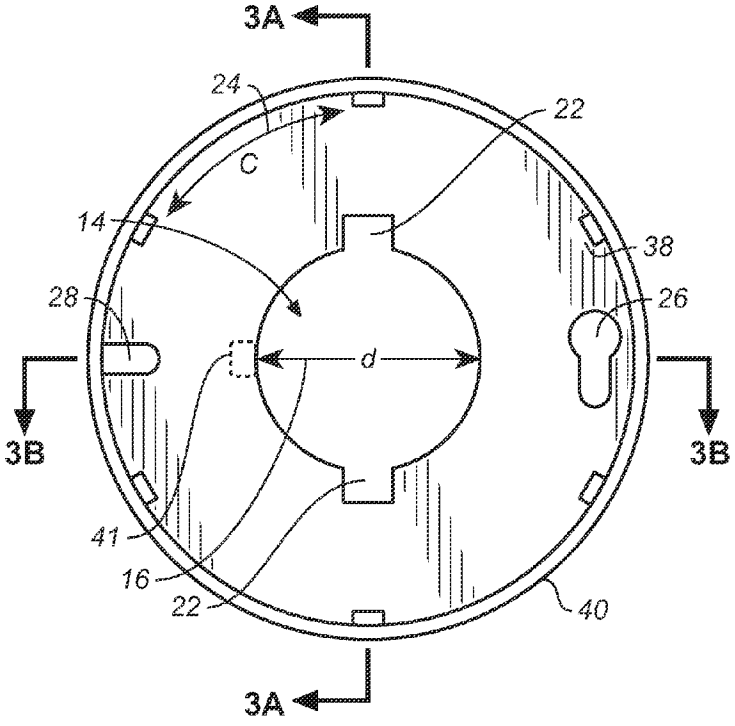
FIG. 2 is a top plan view showing the base plate thereof.
Figure 1:
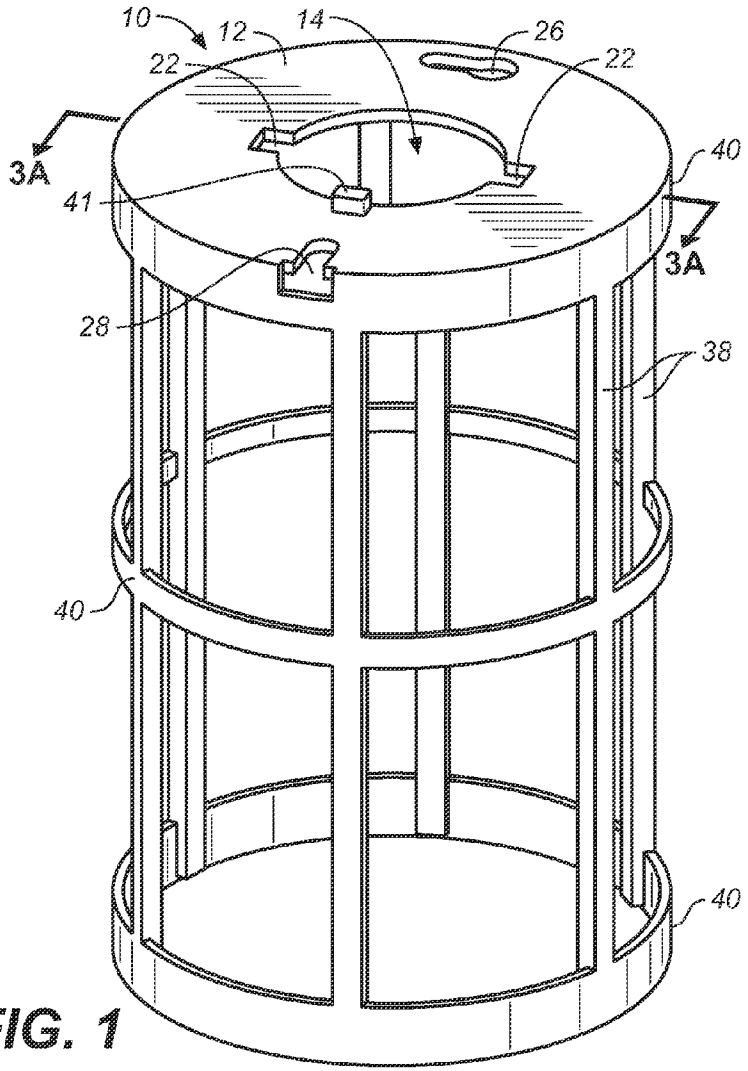
FIG. 1 is an upper perspective view showing a preferred embodiment of the lamp guard of the present invention.

Referring to FIGS. 1 through 3B, wherein like reference numerals refer to like components in the various views, there is illustrated therein a new and improved lamp guard, generally denominated 10 herein. FIGS. 1-3B illustrate a preferred embodiment of the lamp guard. Collectively, these views show that the inventive apparatus comprises a planar base plate 12 having a center hole 14 with a diameter 16 sized for a light socket 18, preferably a medium base light socket. As is shown in FIG. 3A, the light socket may be used in connection with a front mount snap-in type socket with shoulder springs, such that the base plate is snapped onto shoulder spring—the annular groove 20 of the shoulder spring accepts and is captured by the base plate center hole, such that the arms 21 of the shoulder spring on the socket fit within opposing side slots 22 disposed 180 degrees apart from one another and extending radially from the center hole, such that the shoulder spring arms are securely urged against the base plate. Proximate the outer circumference 24 of the base plate are a keyhole slot 26 and a transverse slot 28, each sized to accommodate screws 30 for securing and mounting the base plate onto the ears 32 of an outlet box 34 or a plaster ring mounted on the outlet box, as are found in walls and ceilings 36 in most buildings. The keyhole slot and transverse slot are positioned substantially 180 degrees apart from one another around the circular base plate.

At least two, and preferably five, spaced apart spokes 38 of substantially equal length extend substantially perpendicular from the base plate so as to provide structure for two or more rings 40 to form the cage elements that surround and protect a light bulb. An small knob 41 may be vertically disposed on the surface of the base plate when the light guard is to be installed on two piece socket base, such at the Satco 90-1111 two-piece medium base porcelain socket manufactured by Satco Products of Brentwood, N.Y. The knob engages socket recess to prevent rotation of the base plate about the socket.

The base plate, spokes, and rings may be fabricated from any of a number of suitable materials, including aluminum and hard plastics, though the base plate is sturdy while yet slightly pliable so as to permit the light socket to snapped into place, as described above, and then reused. The light socket may be removed by unscrewing the socket or by using a screwdriver or other comparable tool by inserting the tool in one or both of the side slots 22 and gently prying the socket loose. Thus, if any damage to the socket should occur, replacement is simple and need not even involve removal of the lamp guard.

Figure 3A:
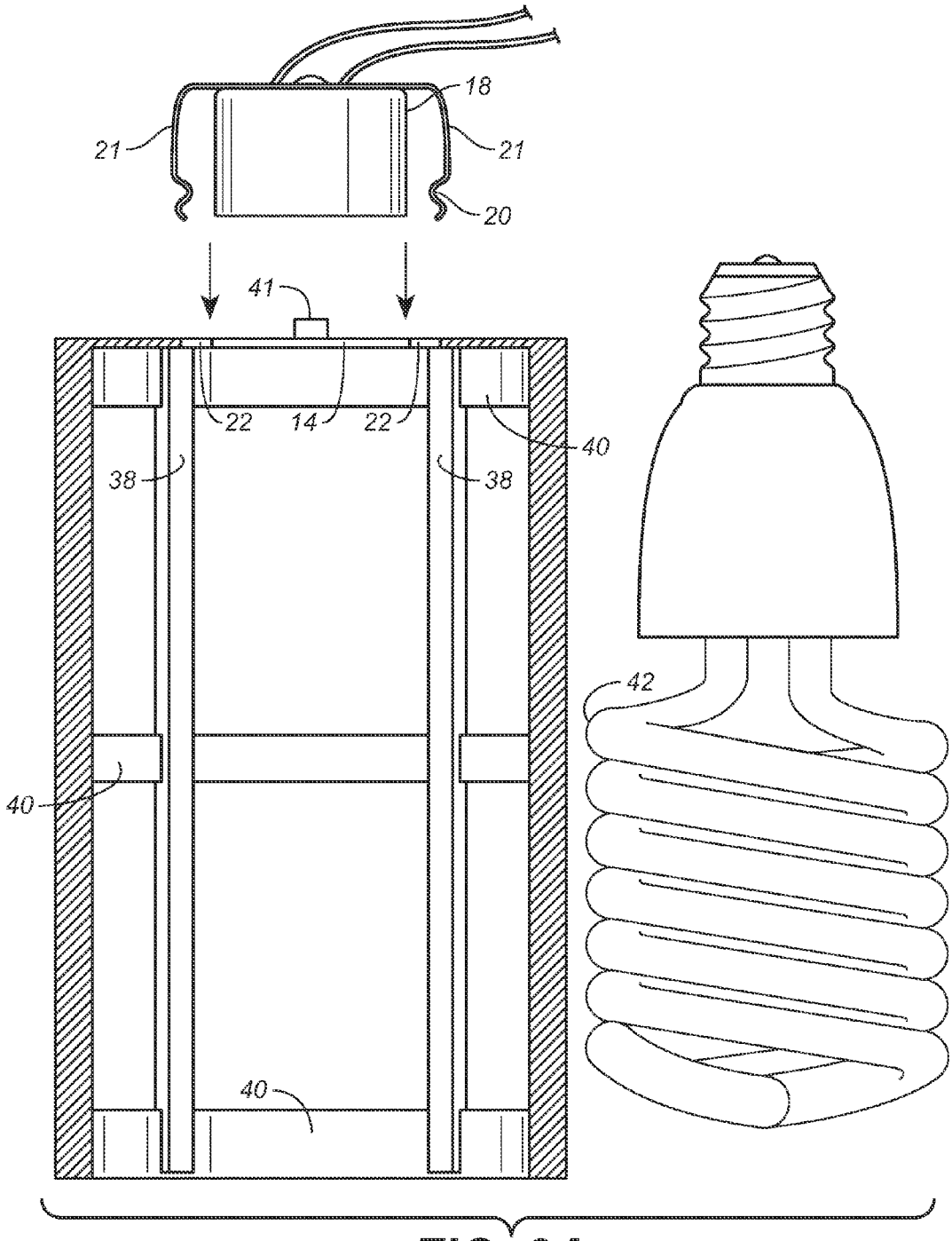
FIG. 3A is an exploded side view in elevation showing the light cage and a light suitable for use therewith.
Figure 3B:
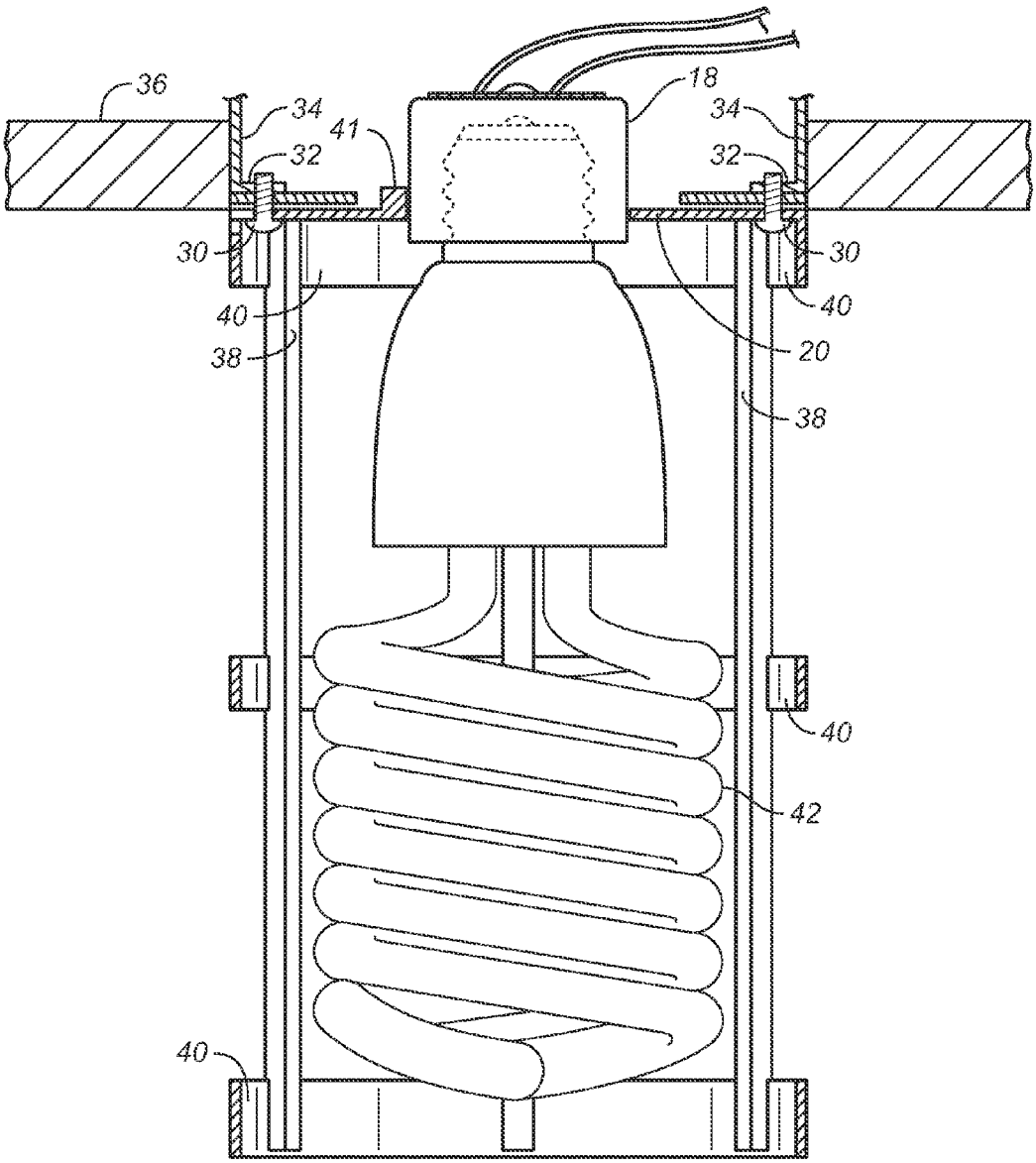
FIG. 3B is a cross-sectional side view in elevation showing the lamp guard installed in a ceiling outlet and attached to the outlet box.

As may be readily seen by reference to FIG. 3B, the base plate and rings are dimensioned to be no larger than the outlet box and/or a plaster ring mounted on the outlet box. Further, the cage does not include any elements preventing free access to the light bulb 42. Accordingly, changing a protected bulb entails nothing more than simply screwing it out.

Most importantly, once wall and/or ceiling finishing is completed, the light guard is easily removed and replaced by a new fixture. Accordingly, there is also disclosed herein a method of temporarily lighting a construction work space using a light protected by the inventive light cage installed in a wall and/or ceiling outlet. This obviates the need to use temporary and portable task and work lighting, such as handlamps, tower lights, and string lights, as well as all the attendant extension cords, cord protectors, temporary power distribution equipment, and so forth.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A light guard, comprising:

a planar base plate having a center hole sized to permit the passage of a light socket and opposing side slots disposed substantially 180 degrees apart from one another, said base plate having an outer circumference sized substantially the same as the outer dimension of a selected electrical outlet box;

a keyhole slot proximate said outer circumference of said base plate;

a transverse slot proximate said outer circumference of said base plate;

said keyhole slot and said transverse slot sized to accommodate screws for securing and mounting said base plate directly onto an outlet box or a plaster ring mounted on the outlet box;

at least two spaced apart spokes of substantially equal length extending substantially perpendicular from said base plate; and at least two rings connecting said spokes so as to form a light bulb cage;

wherein when said light guard is directly affixed to an electrical outlet box to secure a light socket, the light socket is disposed through said center hole in said planar base plate and is captured by said base plate such that the light socket is disposed through the center hole of the base plate so as to be held at least partly within the electrical outlet box.

2. The light guard of claim 1, further including a knob vertically disposed on the surface of the base plate.

3. The light guard of claim 1, wherein said base plate and said rings are dimensioned to be no larger than a predetermined outlet box and/or a plaster ring mounted on the outlet box.

4. The light guard of claim 1, wherein said light bulb cage is open at a bottom end so as to permit free access to a light bulb installed therein.

5. A method of providing temporary lighting in an indoor construction site, comprising the steps of:

(a) providing a temporary light guard having a base plate with a center hole sized to permit the passage of a light socket and an outer circumference sized substantially the same as the outer dimension of a selected electrical outlet box, slots or holes for affixing the base plate directly to the electrical outlet box or a plaster ring mounted on the outlet box, a plurality of spokes of substantially equal length extending substantially perpendicular from the base plate, and at least two rings connecting the spokes so as to form a light bulb cage having an open end;

(b) securing the light socket within the center hole of the base plate, such that the light socket is captured by the base plate and disposed through the center hole of the base plate so as to be held at least partly within the electrical outlet box;

(c) attaching the light guard directly to the electrical outlet box or plaster ring mounted on the outlet box;

(d) installing a light bulb in the light socket;

(e) using the light for illumination during construction procedures, including at least wall installation, wall texturing, and wall painting; and (f) removing the light guard after construction procedures in step (e) are completed.

6. A temporary light guard, comprising:

a base plate with a center hole for the passage of a light socket, said base plate having an outer circumference sized substantially the same as the outer dimension of a selected electrical outlet box;

first and second opposing slots proximate said outer circumference of said base plate for affixing said base plate with screws directly to an electrical outlet box or a plaster ring mounted on the electrical outlet box;

at least two spaced apart spokes of substantially equal length extending substantially perpendicular from said base plate;

at least two rings connecting said spokes so as to form a light bulb cage having an open end such that access to the light bulb does not require the movement or removal of any structure or element of said temporary light guard; and a light socket disposed through and captured within said center hole in said base plate such that said light socket is captured by the base plate so as to extend through said center hole and to be held at least partly within the electrical outlet box.

* * * * *